US005937762A

United States Patent [19]

Herbert

[11] Patent Number: 5,937,762

[45] Date of Patent: Aug. 17, 1999

[54] APPARATUS FOR PRINTING POSTAL IMPRESSIONS AND METHOD OF IDENTIFYING ORIGIN OF POSTAL IMPRESSION

[75] Inventor: Raymond John Herbert, Leigh-on-Sea, United Kingdom

[73] Assignee: Neopost Limited, Essex, United Kingdom

[21] Appl. No.: 08/851,851

[22] Filed: May 6, 1997

[30] Foreign Application Priority Data

May 8, 1996 [GB] United Kingdom ..... 9609615

[51] Int. Cl.[6] ..... B41F 1/28

[52] U.S. Cl. ..... 101/483; 101/491; 400/106; 356/71; 380/51; 162/134; 364/478.14

[58] Field of Search ..... 101/483, 491, 101/335; 400/106, 107; 356/71; 380/51; 162/134; 364/478.14; 250/461.1

[56] References Cited

U.S. PATENT DOCUMENTS

| | | | |
|---|---|---|---|
| 3,599,229 | 8/1971 | Merrell | 400/106 |
| 3,881,941 | 5/1975 | Kernohan | 252/515 |
| 4,485,308 | 11/1984 | Rabatin | 250/461.1 |
| 4,504,357 | 3/1985 | Holben et al. | 162/134 |
| 4,767,205 | 8/1988 | Scwartz et al. | 356/71 |
| 4,864,618 | 9/1989 | Wright et al. | 380/51 |
| 4,995,315 | 2/1991 | Koper et al. . | |
| 5,302,825 | 4/1994 | Abumehdi et al. . | |
| 5,450,190 | 9/1995 | Schartz et al. | 356/71 |
| 5,592,561 | 1/1997 | Moore | 382/103 |
| 5,612,889 | 3/1997 | Pintsov et al. | 364/478.14 |
| 5,660,111 | 8/1997 | Herbert | 101/491 |

FOREIGN PATENT DOCUMENTS

| | | |
|---|---|---|
| 0219847 A2 | 10/1986 | European Pat. Off. . |
| 1193511 | 6/1970 | United Kingdom . |
| 2175851 | 12/1986 | United Kingdom . |
| 2205783 | 12/1988 | United Kingdom . |
| 2223453 | 4/1990 | United Kingdom . |
| 2275668 | 9/1994 | United Kingdom . |
| 2289150 | 11/1995 | United Kingdom . |

*Primary Examiner*—Eugene Eickholt
*Attorney, Agent, or Firm*—Shoemaker and Mattare Ltd.

[57] ABSTRACT

A method of identifying a franking machine used to print franking impressions is disclosed. Ink used by the franking machine contains an identification tag unique to each franking machine, or to a group of franking machines, and the impression printed by the franking machine is sensed to determine the identity of the tag and hence to determine the identity of the franking machine used to print the impression. The tag may be chemically unique or may be physically unique. The physically unique tag may have a unique shape or size or may bear a unique marking.

8 Claims, 3 Drawing Sheets

APPARATUS FOR PRINTING POSTAL IMPRESSIONS AND METHOD OF IDENTIFYING ORIGIN OF POSTAL IMPRESSION

BACKGROUND OF THE INVENTION

This invention relates to systems for printing franking or postal impressions on mail and other items to indicate that a charge for handling the item has been accounted for.

Franking machines for franking items of mail by printing an authorised franking impression on the mail item are well known. In such machines the impression printed comprises an invariable pattern determined by the postal authority together with a variable part which indicates data variables such as a postage charge for the item and the date on which the impression is printed. The invariable pattern usually includes data identifying the franking machine and the postal office responsible for receiving mail items franked by that machine.

It will be appreciated that the printing of a franking impression on a mail item represents a charge for handling that item and hence it is necessary that proper accounting is carried out in respect of printing of such franking impressions. From the point of view of the postal authority, revenue from postage charges in respect of franked mail items is determined by the accounting carried out in respect of printing of franking impressions on mail items. Accordingly the postal authority needs to be assured that the accounting is properly and exactly carried out so that the postal authority can ensure that the correct revenue is received for mail items handled by the postal authority. Similarly the user of a franking machine needs to be assured that the charges paid to the postal authority are correct in respect of the franked items of mail.

The postal authorities require manufacturers of franking machines to take such steps as may be necessary to eliminate or at least reduce to an acceptable minimum the risk of fraudulent use of franking machines. Accordingly such machines are constructed in a secure manner with those parts of the machine concerned with carrying out accounting functions and setting of a postage charge value to be printed being housed in a sealed secure housing to which access by authorised personnel only is permitted and evidence of any unauthorised access is provided for example by breakage of a seal.

However while fraudulent use of franking machines can be reduced or eliminated by appropriate construction of the machine a further possibility of fraud on the postal authority is the use of copying machines capable of printing in a colour, corresponding to that of inks used in franking machines, to print copies of a single franking impression printed by a franking machine. With the common availability of copying machines capable of producing copies of franking impressions which are difficult to distinguish from genuine franking impressions printed by franking machines this is of major concern to postal authorities.

SUMMARIES OF THE INVENTION

According to one aspect of the invention apparatus for printing postal impressions includes printing means for printing postal impressions on mail items or the like and ink supply means to supply ink to said printing means; said ink supplied to said printing means including an identification tag having a characteristic identifying said ink whereby an origin of the printed postal impression can be identified by the presence of said identifying tag in the printed postal impression.

According to a second aspect of the invention a method of identifying an origin of a printed postal impression includes the steps of including an identification tag having a unique identifiable characteristic in ink used to print the postal impression, said tag being unique to said origin; and reading the printed postal impression to identify the identification tag in the printed postal impression and thereby identify the origin of the postal impression.

According to a third aspect of the invention a method of identifying apparatus utilized to print a postal impression includes the steps of including an identification tag having a unique identifiable characteristic in ink used to print the postal impression, said tag being unique to said apparatus; and reading the printed postal impression to identify the identification tag in the printed postal impression and thereby identify the apparatus.

According to a fourth aspect of the invention a method of identifying a group of apparatuses utilized to print postal impressions includes the steps of including an identification tag having a unique characteristic in ink used to print the postal impressions, said identification tag being unique to said group of apparatuses; and reading the printed postal impressions to identify the identification tag in the printed postal impressions and thereby identify the group of apparatuses.

BRIEF DESCRIPTION OF THE DRAWING

An embodiment of the invention will now be described by way of example with reference to the drawings in which.

DESCRIPTION OF THE PREFERRED EMBODIMENT

Figure 1:
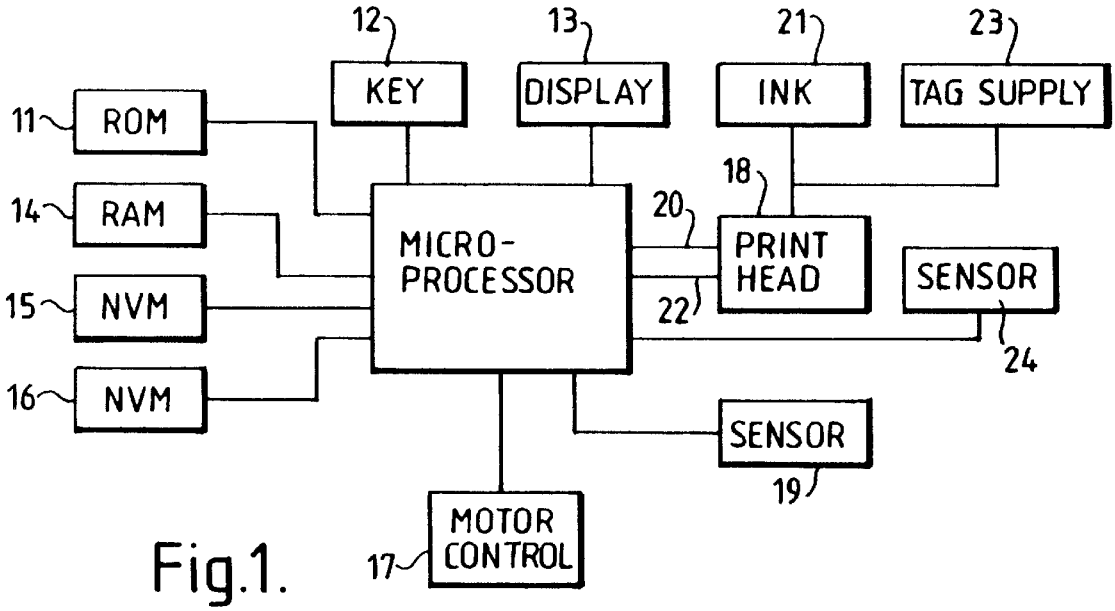
FIG. 1 shows diagrammatically a franking machine in accordance with the invention.

Referring to the drawing a franking machine includes a micro-processor 10 operating under program routines stored in a read only memory (ROM) 11. A keyboard 12 is provided for input of data by a user and a display 13 is provided to enable display of information to the user. A random access memory (RAM) 14 acts as a working store for storage of temporary data during operation of the franking machine. Non-volatile duplicated memories 15, 16 store data which is required to be retained even when the franking machine is not powered. Accounting data relating to use of the franking machine for printing franking impressions representing postage charges for mail items and any other critical data to be retained is stored in the non-volatile memories 15, 16. A motor controller 17 is controlled by the microprocessor to control operation of motors for driving feed means (not shown) for feeding mail items past a print head 18. A sensor 19 is provided to sense the presence of a mail item. The sensor 19 provides signals to the microprocessor 10 to enable the microprocessor to initiate operation of the machine to print a franking impression. The print head 18 may be a print drum carrying a fixed print die for printing an invariable pattern and print wheels to print variable data. One set of print wheels is provided to print the current date and second set of print wheels print the value of postage charge. The print wheels are set to the required value by signals from the microprocessor on line 20. When a mail item is present, as determined by sensor 19, and it is desired to print a franking impression on that item the microprocessor outputs a trip signal on line 22 to cause rotation of the print drum such as to print the franking impression. As is well known those parts of the franking machine concerned with carrying out accounting and control functions in relation to franking of mail items are housed in a secure housing to prevent unauthorised access thereto. The general construction and operation of franking machines is well known and accordingly it is believed to be unnecessary to describe the franking machine in further detail.

Ink for printing the franking impression is supplied from an ink supply 21 to the print head. The ink supply 21 may be an inked roller 40 (see FIGS. 3 and 4) with which the print die and print wheels carried by the print drum engage during rotation of the print drum prior to engagement of the print die and print wheels with the mail item.

Generally the same formulation of ink is used in all franking machines of any given manufacturer or in all those machines having an ink supply, for example ink roller, supplied by a given ink supply manufacturer and hence franking impressions cannot be identified as having been printed by a specific franking machine.

However in accordance with the invention the ink supply of the franking machine contains ink which is uniquely identified whereby not only can a genuine franking impression printed on a mail item be identified as a genuine impression but also if desired the franking machine utilized to print the impression can be identified.

In order to enable identification of the franking machine which printed any selected franking impression the ink, in the ink supply 21 which is supplied to the printing elements of the print head, contains a substance which has an identifiable characteristic, the characteristic being unique to a specific franking machine. One example of a substance having an identifiable characteristic is a chemical substance which has been reacted in such a manner as to produce a unique chemical tag. The chemical may be one in which hydrogen has been replaced by deuterium and then reacted in order to produce a unique chemical tag for admixing with the ink. Such a chemical tag may provide billions of unique tags or markers. The concentration of the altered chemical may be as low as parts per billion or less. The ink containing the chemical tag may be "read" by mass spectroscopy or gas chromatography. Accordingly if a franking impression 30 printed on a mail item 31 is "read", by sensing means 32, to identify the chemical tag the franking machine to which that specific ink was supplied and used to print the franking impression can be identified. It will be appreciated that if "reading" any franking impression does not reveal an authorized chemical tag the franking impression 30 is shown to have been printed in an unauthorized manner and steps can be taken to reject the mail item 31 from further handling by the postal authority.

Instead of the ink including a tag having a unique chemical characteristic as described hereinbefore, the ink may include a tag comprising microparticles of which the unique characteristic is an identifiable physical characteristic. The physical characteristic may take one or more of a plurality of forms and for example may be the shape or size of the particles or a marking on the particles. The marking may take the form of a simple identifiable marking or of a code, for example a bar code. The microparticles may have only one of these physical characteristics or a combination of more than one of these characteristics. The microparticles forming the tag may be uniform and have the same characteristic or characteristics. However if desired the tag may comprise a mixture of microparticles, for example some of the microparticles have a first characteristic or characteristics and others of the microparticles have a second characteristic or characteristics. The mixture may contain more than two different identifiable kinds of microparticles to enable provision of a greater number of combinations of characteristics. The microparticles may fat have a size comparable with the size of particles of a component or components of which the ink is manufactured and for example the largest dimension of the microparticles may be $10\mu$ or smaller. Such particles may be manufactured using micromachining on a silicon wafer. Sufficient of the microparticles are included in the supply of ink to the print head as to ensure that each printed franking impression contains some of the microparticles. Where all the microparticles are identical, provided at least a single microparticle can be detected in the printed franking impression by the reading means 32, the microparticle can be identified by the reading means and hence that franking machine which printed the franking impression 30 can be identified. Where the ink contains a mixture of different types of identifiable microparticles, it is sufficient that at least one of each type of identifiable microparticle can be detected by the reading means. However it will be appreciated that in practice a larger number of microparticles would be present in the printed impression 30.

It will be appreciated that sufficient of the tag having a unique characteristic is present in the ink used to print the franking impression as to enable reading means 32 to detect the presence of the tag and identify the tag. When the tag has a unique chemical characteristic, the concentration of the tag in the ink is required to be sufficient to be detected and identified by methods such as mass spectroscopy or gas chromatography. When the tag has a unique physical characteristic or characteristics sufficient microparticles must be present in the printed impression as to facilitate detection and identification of the particles and, when a mixture of microparticles is used as a tag, sufficient of each kind of microparticles must be present in the printed impression to facilitate detection and identification of each kind of particle.

As described hereinbefore, the identification tag is unique to a specific franking machine but if desired the tag may be unique for a group of franking machines, for example franking machines operated by a single user, franking machines operated in a specific postal region, franking machines manufactured or supplied by a specific manufacturer or supplier or any other desired group of franking machines.

Figure 3:
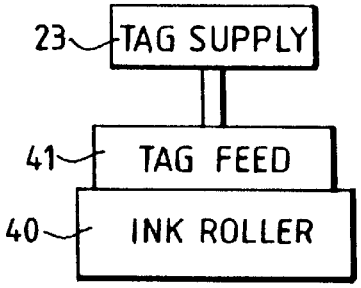
FIG. 3 illustrates diagrammatically means for supplying ink containing a unique tag to an inking roller.
Figure 4:
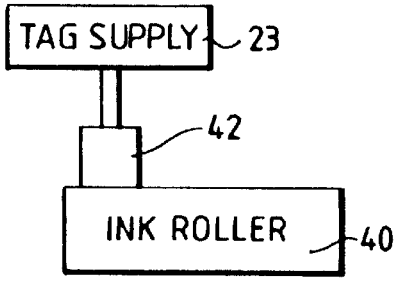
FIG. 4 is similar to FIG. 3 illustrating supplying ink containing a unique tag to only a band of the inking roller.
Figure 2:
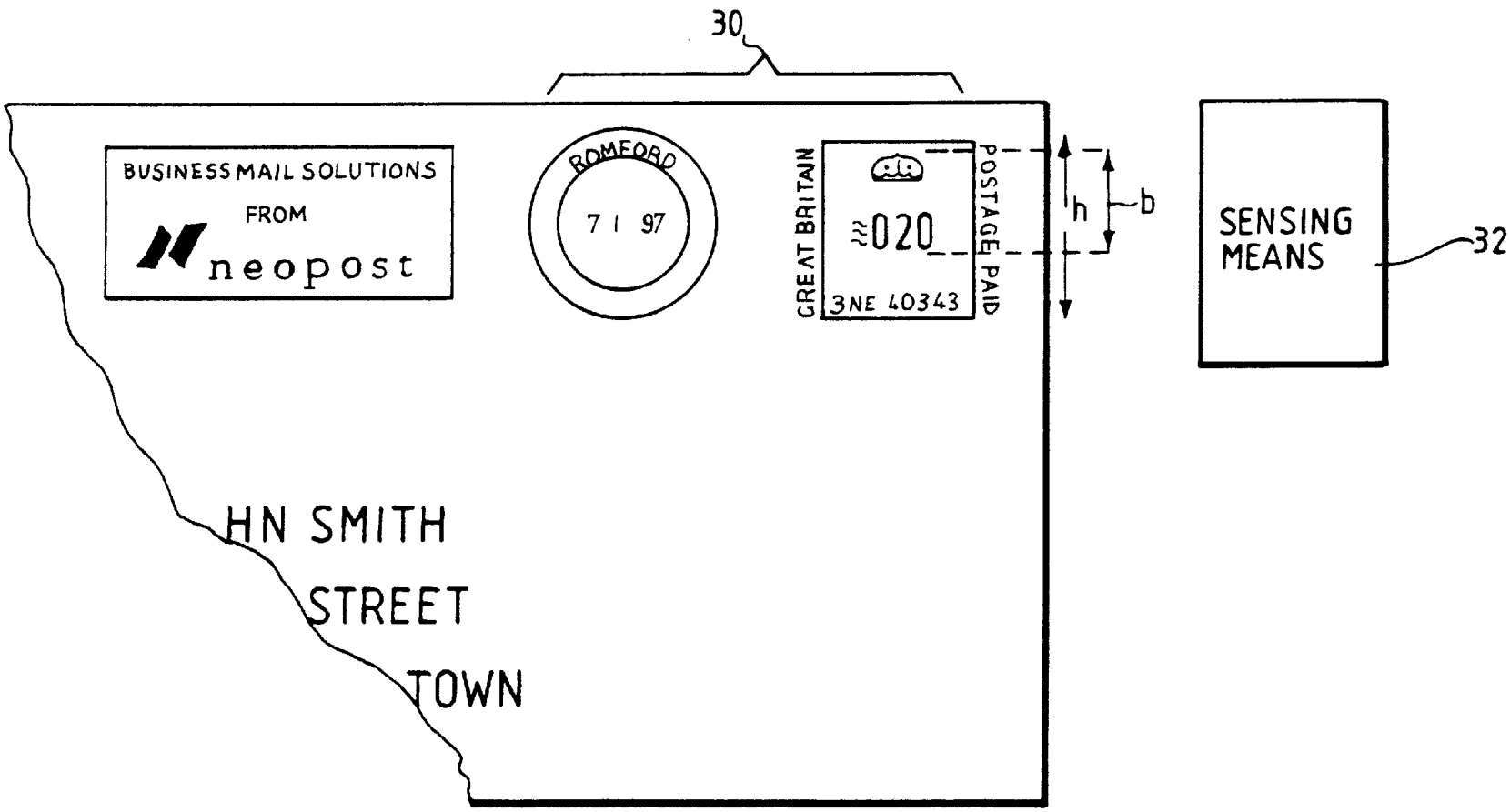
FIG. 2 shows a printed franking impression on a mail item and sensing means for identifying the ink used to print the impression.

The ink supply for franking machines needs to be replenished relatively frequently particularly when there is high volume use of the franking machine. Accordingly where it is desired to provide unique identification of each franking machine the logistics of providing a replenishment supply of ink which is unique for each machine may be unacceptably expensive. In order to reduce this cost the franking machine may be provided with a normal non-specific ink supply 21 and a supply 23 of an identification tag as shown in the drawing. The identification tag is a fluid substance or is carried in a fluid substance. If desired, the fluid substance carrying the identification tag may be ink of the same composition as that of the ink in the non-specific ink supply 21 or ay be a substance readily miscible with the ink from the supply 21. The ink supply 21 supplies the major part by volume of the ink supplied to the printing means for printing the franking impression and is replaceable as in known franking machines. The supply 23 of the identification tag is fitted at the time of manufacture of the franking machine and supplies the identification tag to be mixed in a very low proportion with the ink from the ink supply 21. Thus the mixed ink supplied to the print head contains a very small proportion of the identification tag. Where the ink supply 21 is an inked roller, (as illustrated in FIGS. 3 and 4) the identification tag may be fed to an ink roller 40 by a drip or capillary feed 41 during use of the machine. The identification tag may be mixed relatively uniformly with the non-specific ink so that the tag is present throughout the extent of the franking impression 30. For example, as shown in FIG. 2, a franking impression 30 is printed progressively from right to left (as shown in the drawing) on a mail item 31. With the identification tag mixed relatively uniformly with the non-specific ink the identification tag will be present throughout the height 'h' of the printed franking impression. This may be accomplished as shown in FIG. 3 by a tag feed 41 that supplies the unique tag to substantially the entire width of the ink roller 40. Alternatively the identification tag may be mixed with the non-specific ink to a limited extent such that a band or area of height 'b' of the printed franking impression 30 contains the identification tag. This may be accomplished as shown in FIG. 4 by a tag feed 42 that supplies the unique tag to only a part of the width of the ink roller 40.

An ink level sensor 24 is provided to detect that there is identification tag present in the machine, signals from the sensor 24 being provided to the microprocessor 10. The microprocessor is programmed to monitor the sensor 24 and to permit a franking operation to be carried out only if the sensor 24 indicates that identification tag is present in the supply 23.

Since only a relatively small amount of identification tag is used as compared with non-specific ink, the tagged ink supply 23 requires relatively infrequent replenishment and hence the logistics of ensuring a supply of identification tag for each franking machine or group of machines, the identification tag being unique to a specific franking machine or specific group of franking machines, are simplified and less costly and for example replenishment of the unique identification tag may be carried out as part of a periodical service routine by a service engineer.

If desired impressions printed for different purposes may include different identifiable tags. For example, if the franking machine is to be used to print impressions in respect of items to be handled by different carriers a separate supply of each different tag may be provided in the franking machine and means is operated in dependence upon the carrier selected to select the appropriate tag supply. It will be appreciated that selective tagging of the ink used to print the impression may be utilized for other purposes.

While hereinbefore reference is made to printing franking impressions, other postal impressions may be printed on mail items. Generally franking impressions have a prescribed form authorized by the postal authority and are well known. However it may be desired to indicate that payment of a postage charge for a mail item has been accounted for by means of a different form of printed impression that is acceptable to the postal authority and which may not have the appearance and form of known franking impressions. Accordingly it is to be understood that the present invention is not limited to conventional forms of franking impression and includes within its scope the printing of other forms of postal impression. Furthermore, the printed impression containing the identifiable tag or tags may be or form part of a so-called franking impression or may be a printed area adjacent to the so-called printed franking impression.

Generally franking impressions and other postal impressions previously have been printed by franking machines specifically constructed to perform accounting in respect of postage charges to be applied to mail items and printing of postal impressions on the mail items to indicate that proper accounting for the postage charge has been effected. However such postal impressions may be printed on mail items by a general purpose printer controlled by a general purpose computer such as a personal computer, means being provided to carry out securely accounting in respect of printed postage charges. Accordingly it is to be understood that the invention is not limited to conventional forms of franking machine but includes within it scope other apparatus arranged and controlled to print postal impressions on mail items.

Instead of an inking roller co-operating with print dies to print the postal impression, other forms of printer which do not employ an inking roller may be utilized to print the postal impression. For example printing may be effected by means of a thermal printer in which heatable printing elements are selectively heated to cause transfer of ink from an ink layer carried by a thermal ink transfer ribbon. It will be understood that with such printers, the ink layer carried by the ribbon contains an identifiable tag. If it is desired to provide ribbon with non-specific ink, the identifiable tag may be carried in a layer of a second ribbon. The second ribbon may be acted on by elements of the thermal print head which do not act on the ribbon carrying non-specific ink or a second head may be provided to transfer material from the second ribbon to the mail item. It will be appreciated that the second print head may be only a simple device and may be capable of printing only a single area superimposed or adjacent to the printed postal impression.

Figure 5:
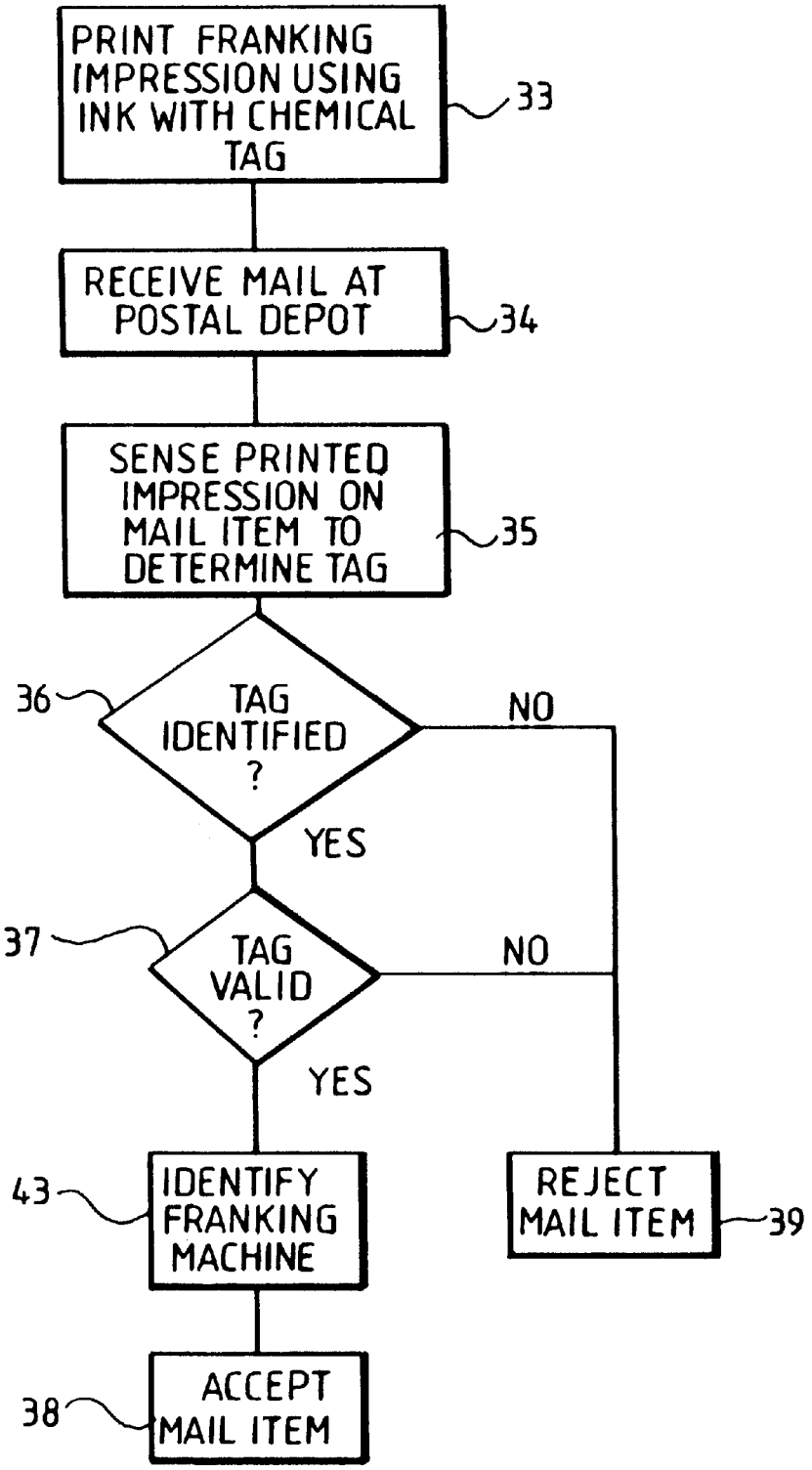
FIG. 5 is flow chart illustrating steps in printing a franking impression and determining identity of a franking machine used to print the franking impression.

The sequence of steps of printing a franking impression and sensing the ink if the printed impression to determine identity of the franking machine used to print the impression is illustrated in the flow chart of FIG. 5. The franking machine uses ink containing a chemical tag unique to that franking machine to print (box 33) the franking impression 30 on the mail item 31. The mail is received (box 34) at a postal authority depot for delivery to a destination. The postal authority utilizes the sensing means 32 to sense (box 35) the ink with which the franking impression 30 has been printed and to determine (box 36) the chemical tag contained in the ink. If the chemical tag is identified (YES output of box 36), the sensing means determines (box 37) if the identified chemical tag has been issued in respect of a franking machine and hence if it is a valid tag. If the tag is valid, the mail item is accepted for handling (box 38). However if the chemical tag is not identified (NO output of box 36) or the tag is not valid (NO output of box 37) the mail item is rejected (box 39). If desired, after identification of the tag, the identity of the franking machine in respect of which the identified tag has been issued may be determined (box 43) for example by reference to a data cross-linking the unique tags with specific franking machines.

I claim:

1. Apparatus including printing means for printing postal impressions on mail items and ink supply means to supply ink to said printing means; said ink supplied to said printing means by said ink supply means including microparticles, said microparticles each bearing a unique physical marking identifying said ink whereby an origin of the printed postal impression can be identified by the presence of at least one of said microparticles bearing the unique physical marking in the printed postal impression.

2. Apparatus as claimed in claim 1 wherein the microparticles bear a unique physical marking representing a code.

3. Apparatus as claimed in claim 2 wherein the microparticles bear a unique physical marking in the form of a bar code.

4. A method of identifying an origin of a printed postal impression including the steps of including microparticles bearing a unique identifying physical marking in ink used to print the postal impression at an origin of printed postal impressions, said microparticles bearing said unique identifying physical marking being unique to said origin; and inspecting the printed postal impression for the presence of at least one microparticle bearing a physical marking; determining the identifying physical marking on the microparticle to thereby identify the origin of the postal impression.

5. A method of identifying apparatus utilized to print a postal impression including the steps of including microparticles bearing a unique identifying physical marking in ink used to print the postal impression at an origin of printed postal impressions, said microparticles bearing said unique identifying physical marking being unique to said origin; and inspecting the printed postal impression for the presence of at least one microparticle bearing a physical marking; determining the identifying physical marking on the microparticle to thereby identify the origin of the postal impression.

6. A method as claimed in claim 5 wherein the apparatus is a member of a group of postal impression printing apparatuses and the steps of the method comprise including microparticles bearing the same unique identifying physical marking in ink used by each apparatus of the group, said microparticles bearing said unique identifying physical marking being effective to identify the group of apparatuses of which the apparatus used to print the postal impression is a member whereby determination of the identifying physical marking identifies the group of apparatuses of which the apparatus used to print the postal impression is a member.

7. A method as claimed in claim 5 in which the printing of the postal impression is effected using a non-specific ink not containing the microparticles combined with substance comprising or containing the microparticles.

8. A method as claimed in claim 7 including the step of combining the substance with the non-specific ink at a time at which the non-specific ink is supplied to printing means to print the postal impression.

* * * * *